United States Patent [19]

Tanaka et al.

[11] Patent Number: 4,649,054

[45] Date of Patent: Mar. 10, 1987

[54] BEER CONTAINER HAVING MEANS FOR FROTHING THE CONTENT THEREOF

[75] Inventors: Hideo Tanaka, Takarazuka; Kuniyoshi Ohhashi, Ikeda; Tatsuya Gomi, Sakai; Tomoyuki Dobashi, Fujisawa, all of Japan

[73] Assignees: Suntory Limited, Osaka; Dainippon Ink and Chemicals, Inc., Tokyo, both of Japan

[21] Appl. No.: 759,325

[22] Filed: Jul. 26, 1985

[30] Foreign Application Priority Data

| | | | |
|---|---|---|---|
| Aug. 1, 1984 | [JP] | Japan | 59-162171 |
| Aug. 7, 1984 | [JP] | Japan | 59-121248[U] |
| Aug. 7, 1984 | [JP] | Japan | 59-121250[U] |
| Jan. 22, 1985 | [JP] | Japan | 60-8315 |
| Jan. 23, 1985 | [JP] | Japan | 60-6694[U] |
| Jan. 24, 1985 | [JP] | Japan | 60-7306[U] |
| Jan. 24, 1985 | [JP] | Japan | 60-8639[U] |

[51] Int. Cl.[4] ..... B65B 55/00; B65D 90/00

[52] U.S. Cl. ..... 426/397; 426/519; 220/1 BC; 222/190; 222/196; 222/465.1

[58] Field of Search ..... 206/805; 220/1 BC, 85 R; 222/196, 196.1–196.2, 199–200, 202–203, 190, 191–192, 465 R; 252/307; 366/108, 113–115; 426/112, 115, 131, 397, 405, 519

[56] References Cited

U.S. PATENT DOCUMENTS

| | | | |
|---|---|---|---|
| 1,383,281 | 7/1921 | Bailey | 222/196 |
| 2,724,393 | 11/1955 | Heise | 366/115 |
| 4,279,938 | 7/1981 | Hildebrand | 426/424 |
| 4,322,008 | 3/1982 | Schneider | 215/1 R |
| 4,412,627 | 11/1983 | Houghton et al. | 220/1 BC |

FOREIGN PATENT DOCUMENTS

| | | | |
|---|---|---|---|
| 2733182 | 3/1979 | Fed. Rep. of Germany | 220/85 R |
| 1378692 | 12/1974 | United Kingdom | 222/196 |
| 1578529 | 11/1980 | United Kingdom | 222/196 |

*Primary Examiner*—Joseph J. Rolla
*Assistant Examiner*—Michael S. Huppert
*Attorney, Agent, or Firm*—Burns, Doane, Swecker & Mathis

[57] ABSTRACT

A container for beer such as a can with an arrangement for frothing beer contained therein by which a micro-froth layer is formed on the surface of beer before drinking by imparting vibration to a part of a container wall, which arrangement comprises a mounting member attached to the container wall and a movable member having a free end and another end resiliently connected to the mounting member. In a preferred embodiment, the arrangement is made from a piece of hard plastic which is symmetrical with respect to upper and lower parts thereof and is adapted to be fixed on the concave bottom wall portion of a can.

20 Claims, 27 Drawing Figures

BEER CONTAINER HAVING MEANS FOR FROTHING THE CONTENT THEREOF

BACKGROUND OF THE INVENTION (1) Field of the Invention

The present invention relates to a beer container, such as a can or bottle, utilized for direct drinking of the content, i.e., the beer being drunk directly from the container without being transferred to a receptacle such as a mug. More specifically, it relates to such a container having means for frothing the content thereof just before drinking same.

(2) Description of the Related Arts

It is well known that it is preferable to form a creamy layer of microfroth on the surface of beer just before drinking the beer, as such a layer improves the taste of the beer. Generally speaking, when beer is forcibly poured into a mug from a large size barrel, having a content of, for example, 25 liters or 10 liters, by utilizing a high pressure gas, such as carbonic acid gas, a layer of froth having a good body is formed on the surface of the beer. This layer is formed because carbon dioxide dissolved in a saturated state in the beer accommodated in the barrel, under a high pressure of 2 to 3 kg/cm$^2$, is rapidly gasified by the mechanical impetus imparted on the outflowing beer stream. Contrary to this, in the case of a medium size can suitable for home use or personal use made from a metal or plastic and having a content of, for example, 2 or 3 liters, the beer contained therein is usually completely consumed without necessity to consider restoring a residual content therefore, since a high pressure gas is not necessarily used when pouring the beer out of the container, gasification of the supersaturated carbon dioxide becomes relatively poor.

Many proposals have been made for forming a microfroth layer on the surface of beer accommodated in a medium size container prior to drinking. For example, in Japanese Unexamined Patent Publication (kokai) No. 56-74487, a means is provided for facilitating the gasification of carbon dioxide dissolved in the beer by pouring the beer from a container into a mug through a tap having a main supply opening and at least an auxiliary opening, whereby the beer stream poured from the auxiliary opening taps upon the surface of the poured beer in the mug, which generates vibration and forms a flock of micro-froth on the surface of the beer in a mug. The froth flock is moved to and fro by a beer stream poured from the main supply opening and form a creamy layer on the entire surface of the beer.

In Japanese Unexamined Patent Publication (Kokai) No. 57-28797, a means is proposed for forming a froth layer, comprising a tap for a container having an air inlet pipe designed to have a proper inner diameter and length so as to impart a pulsative movement to an outflowing stream of beer.

The above-mentioned means, however, are effective only for a relatively large size container from which the beer therein is poured into a mug for drinking. Accordingly, these prior arts are not suitable for the purpose of the present invention, in which the beer is drunk directly from the container after a lid thereof has been opened.

SUMMARY OF THE INVENTION

Thus, it is a primary object of the present invention to provide a container of beer in which a creamy microfroth layer can be formed on the surface of beer without utilizing a pressurized gas or a dispenser, the froth layer being similar to the froth layer of a draft beer poured from a large size barrel utilizing a pressurized gas.

It is a second object of the invention to provide a means for forming a creamy micro-froth layer on the surface of beer in a container, this means being utilized together with the container.

The above object of the present invention is achieved by a container of beer comprising, a sealed container body and means for vibrating at least part of a wall of the container body.

The vibrating means may comprise a mounting member attached to the wall of the container and a movable member, one part of which constitutes a free end and the other part being resiliently connected to the mounting member so that a vibration is imparted to the wall by freely vibrating the free end of the movable member.

Alternatively, the vibrating means may comprise a mounting member attached to the wall of the container and a movable member, one part of which constitutes a free end and the other part being resiliently connected to the mounting member so that a vibration is imparted to the wall by striking the wall of the container with the free end of the movable member which has been preliminary resiliently displaced against the wall.

The vibrating means is preferably attached to a side wall or a bottom wall of the container.

The movable members of the vibrating means may be constituted in a form of an ear utilized as a handle of the container.

The most preferable vibrating means, according to the present invention, is that to be used while attached to a bottom wall of a container, comprising a mounting member to be fixed to the bottom wall of the container and a movable member provided with a free end portion at one part thereof and resiliently connected to the mounting member at the other part thereof, the free end portion having at least one projection at a position thereof opposite to the bottom wall of the container when the means is positioned in place. The vibrating means is so utilized that the projection strikes the bottom wall of the container when the movable member is released from a resiliently displaced condition to a free condition. A profile of the projection to be in contact with the bottom wall of the container is so designed that when the container is struck thereby no deformation is imparted to the bottom wall of the container and the maximum width of the contacting area is sufficiently smaller in relation to a wavelength of a vibration propagated in the wall of the container due to the striking of the container thereby.

If more than one projection is used, the projections are preferably arranged at a distance of more than 3 mm from each other.

The mounting member of the vibrating means is preferably constituted by a disc having a convex upper and/or lower surface complementary to that of the bottom wall of the container, and the movable member preferably comprises an annular ring encircling the mounting member. Both members may be connected to each other by a bridge member provided between confronting parts of the peripheries of both members. The projection is arranged in upper and/or lower surfaces of the free end portion of the movable member, which portion corresponds to a part positioned diametrically opposite to the bridge member.

The upper and/or lower surfaces of the mounting member may preferably be roughened to provide a desirable bonding effect when the mounting member is to be adhered to the bottom wall of the container. Further, the roughened surface may be formed of a plurality of ribs. The ribs may be arranged in parallel, in a lattice form, radially or concentrically.

The vibrating means preferably may be of a symmetric form relative to an imaginary plane dividing the upper and lower parts of the vibrating means.

Another aspect of the vibrating means is provided by the present invention, which comprises a mounting member to be attached to the bottom wall of a container, a first movable member encircling the mounting member and a second movable member encircling the first movable member. The mounting member is resiliently connected to the first mounting member at a part of the periphery thereof with a first bridge member and the second movable member is resiliently connected to the first movable member at a part of the periphery thereof with a second bridge member, which part is disposed at a position diametrically opposite to the first bridge member. At least one projection is provided on either side of the first movable member in the vicinity of the second bridge member and/or on either side of the second bridge member along the entire periphery thereof.

According to a further aspect of the present invention, the vibrating means comprises an annular-shaped mounting member to be attached to the bottom wall of a container and a bar-shaped movable member resiliently connected, at an end thereof, to the mounting member and diametrically extending inward therefrom so as to form a free end provided with at least one projection on that free end.

BRIEF DESCRIPTION OF THE DRAWINGS

The other objects and advantages of the present invention will be apparent from the description of the preferred embodiments of the present invention with reference to the accompanying drawings: wherein.

DESCRIPTION OF THE PREFERRED EMBODIMENTS

A principle of the present invention will be explained below by referring to FIGS. 1 and 2.

A layer of fine creamy froth can be obtained on the surface of beer by imparting a localized fine vibration to at least a part of a wall of a container of beer. The above part of a wall may be any portion of the container with which the beer accommodated therein is in contact, such as side or bottom wall of the container. The most preferable portions are the center of the bottom wall and the lower area of the side wall close to the bottom wall.

Localized vibration as used herein means a vibration limited to a narrow area in the vicinity of a position where the vibration has been initiated and, therefore, does not include a natural vibration occurring throughout the entire body of the container.

The term "fine vibration" denotes vibration having a frequency higher than the natural frequency of the container.

Figure 1:
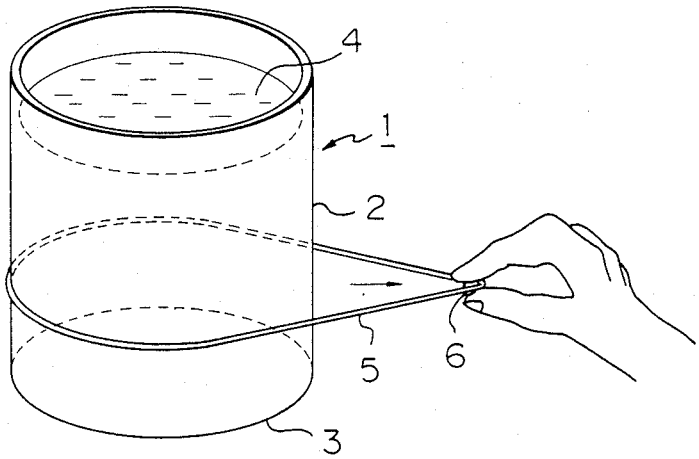
FIGS. 1 and 2 are perspective views of a can of beer illustrating a principle of the present invention.
Figure 2:
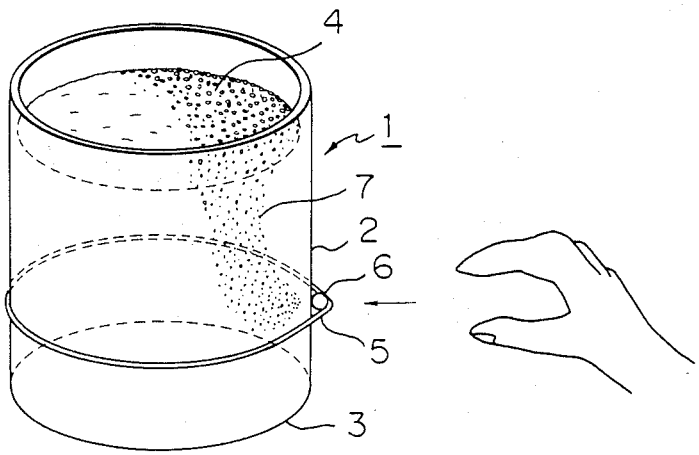

In an example of a method for imparting such a vibration to a container of beer, as illustrated in FIGS. 1 and 2, a rubber string 5 encircles a side wall 2 of a can 1 in which beer 4 is accommodated. A small piece 6 of a hard material such as hard plastic is secured to a part of the rubber string 5. After the can 1 has been opened, the piece 6 is picked up by fingers, pulled together with the rubber string 5 away from a surface of the side wall 2 and then released so that the piece 6 is made to strike the surface of the side wall 3 of the can 1 by the return force of the rubber string 5. According to the impact caused by the striking of the piece 6, a vibration is generated at the struck point of the side wall 2 and is propagated radially therefrom to the surrounding area, causing an amount of microfroth 7 to be generated in the beer. This microfroth 7 is generated first at the point struck and then over a wider area adjacent thereto. This froth 7 rises to and forms a creamy layer on the surface of the beer 4, as illustrated in FIG. 2.

The froth 7 is formed of carbonic acid gas dissolving in the beer which tends to be gasified by a mechanical stimulation imparted thereto in accordance with the following mechanism:

1. Due to the vibration of the wall 2 of the can 1 directly imparted by the striking of the piece 6, the wall pulsates in repeated outward and inward movements, alternately, relative to the neutral plane of the wall 2. When the wall 2 is displaced outward, a small gap or a reduced pressure part is instantaneously formed between the wall and the beer accommodated therein, and the gas forcibly dissolved in the beer under a high pressure is gasified because of this locally generated lower pressure. This is proved by the fact that the froth 7 is generated at the struck point of the wall 2.

2. This initial vibration is propagated radially through the wall 2 of the can 1 to an area surrounding the struck point, and this part of the wall 2 of the can 1 is also displaced as stated above, whereby the froth 7 of the gas is generated. This is proved by the fact that the froth 7 is also generated along a circle concentric to the struck point, especially in the case of striking the center of the bottom wall.

3. The vibration is transmitted not only to the surrounding wall 2 of the can 1 as stated above but also to the beer 4 itself, in which it is propagated as a wave of condensation and rarefaction. Therefore, the froth 7 rises throughout the body of the beer 4 at the final stage.

These phenomena, especially that of item 3, are presented more remarkably in a plastic can than in a metalic can. This is because the initial vibration of the wall is rapidly transferred to the beer body in the former relative to the latter.

Contrary to this, when the container 1 of beer 4 is struck by means of a relatively large body, such as a rod having a heavy mass, little froth 7 is generated, because such a strike cannot impart a localized vibration having a frequency proper to vibrate only a part of the can 1 but causes the whole of the can 1 to vibrate.

Of course, the strike may be imparted to the bottom wall 3 of the can instead of the side wall 2 as stated above.

Some examples embodying the above frothing principle are illustrated in FIGS. 3 through 7.

Figure 3:
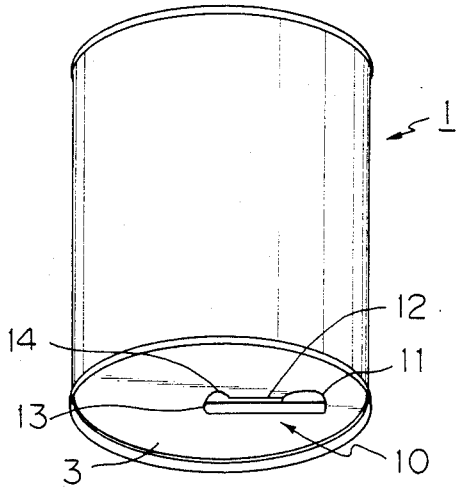
FIG. 3 illustrates a perspective view of a first embodiment of a can according to the present invention.
Figure 4:
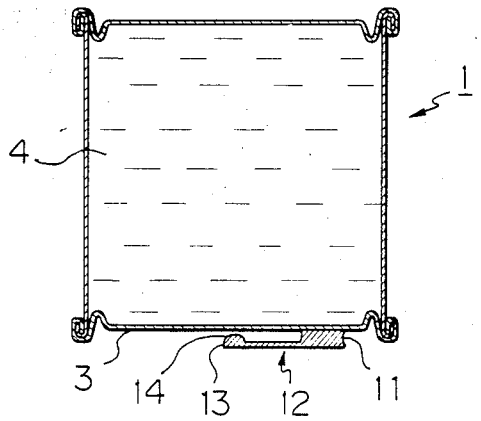
FIG. 4 illustrates a side sectional view of the can shown in FIG. 3.

A first embodiment of the can 1 shown in FIG. 3 is provided with a vibrating means 10 made of metal on the bottom wall 3 of the can 1. The vibrating means 10 comprises a mounting member 11 and a bar-like movable member 12 extending from the mounting member 11 and having an free end 13 to which a striking head 14 is secured. The movable member 12 is resiliently connected to the mounting member 11 which is fixed to the bottom wall 3 of the can 1, as shown in FIG. 4. In use, the free end 13 of the movable member 12 is resiliently lifted away from the bottom wall 3 by the fingers and then released so that the striking head 14 strikes the bottom wall 3. In this case, froth is generated not only at a point struck by the striking head 14 but also at the position corresponding to the mounting member 11, because the vibration of the movable member itself is transmitted to the bottom wall 3 through the mounting member 11. Accordingly, it is possible to eliminate the striking head 14 if the free vibration of the movable member 12 lasts longer.

Figure 5:
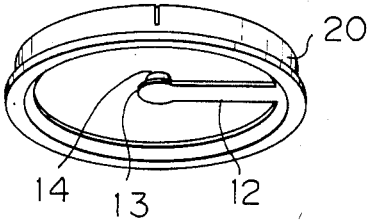
FIG. 5 illustrates a perspective view of another embodiment of a vibrating means according to the present invention.
Figure 6:
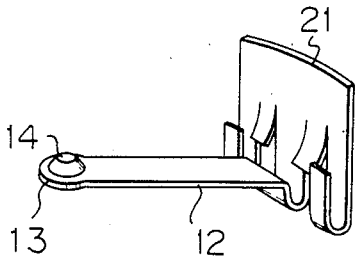
FIG. 6 illustrates a perspective view of a further embodiment of a vibrating means according to the present invention.

The vibrating means 10 may be mounted on the bottom wall 3 by means of a mounting ring 20, as illustrated in FIG. 5, or a hook member 21 as illustrated in FIG. 6.

Figure 7:
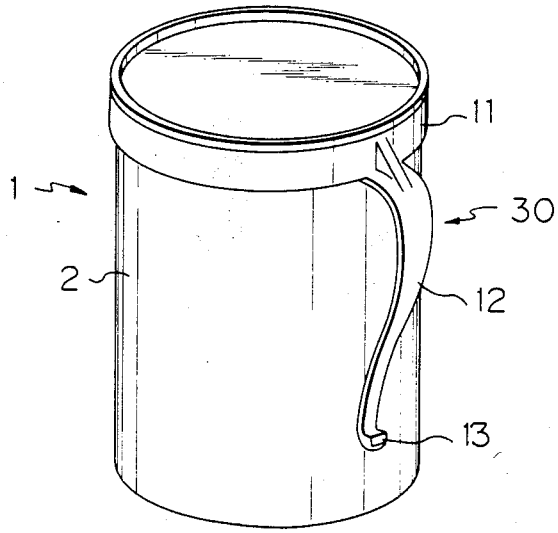
FIG. 7 illustrates a perspective view of a can having vibrating means in the form of an ear, according to the present invention.

If the vibrating means 10 is secured to the side wall 2 of the can 1, it is preferably in the form of an ear 30 of the can 1 as shown in FIG. 7. This means is fitted on the periphery of the can 1 by a mounting ring 11. In this embodiment, the ear 30 constitutes the movable member 12 of FIGS. 3 through 6 and also serves as a handle for holding the can 1 when drinking the beer.

Figure 8:
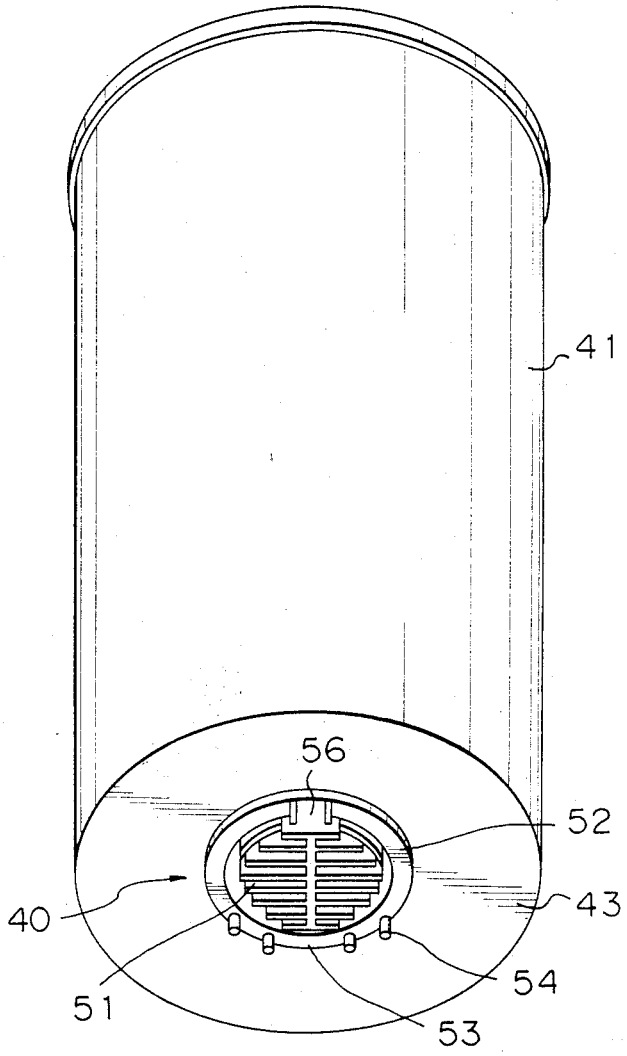
FIG. 8 illustrates a perspective view of a can provided with a first embodiment of the most preferable vibrating means.

One aspect of the most preferable embodiment of a vibrating means 40 according to the present invention is shown in FIGS. 8 though 11, which is improved by taking the actual industrial manufacturing process into account. That is, according to this aspect, the vibrating means can be manufactured utilizing a reduced amount of plastic material and the mounting thereof to the can can be easily automated. A can 41 used for this embodiment is preferably of such a type that a lid thereof can be wholely removed from the container body before drinking the beer and a bottom wall 43 thereof is concaved inward as usual. The vibrating member 40 is attached to the bottom wall 43 as illustrated in FIG. 8.

Figure 9:
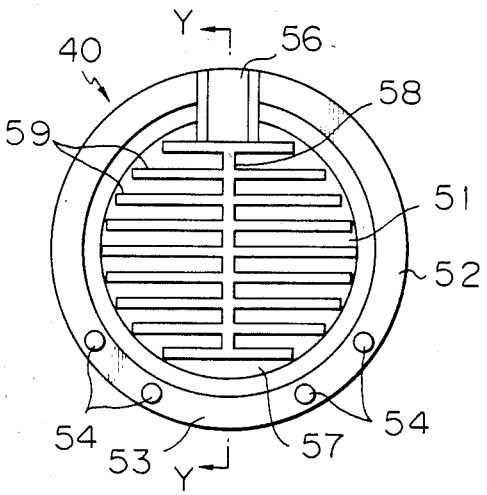
FIGS. 9 and 10 illustrate a plan view and a side view, respectively, of the vibrating means shown in FIG. 8.
Figure 10:
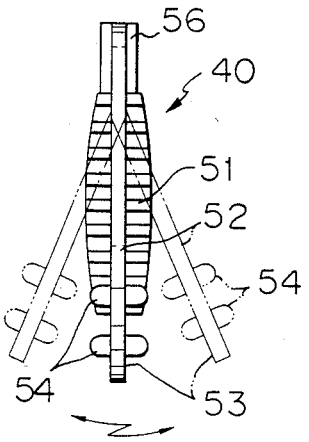

In FIGS. 9 and 10, the vibrating means 40 is preferably made of an elastic material such a a metal or hard plastic and comprises a disc-like mounting member 51 and an movable member 52 having an annular shape and concentrically encircling the mounting member 51. The members 51 and 52 are connected to each other by a bridge member 56 at a part of the peripheries thereof. The mounting member 51 is fixed on a center of the bottom wall 43 of the can 41 in a known manner, such as by an adhesive or by welding. In such a situation, the movable member 52 is able to resiliently move up and down in a hinge fashion about the bridge member 56 as both members 51, 52 are resiliently bent by a force applied perpendicularly to a free end 53 of the movable member 52 disposed diametrically opposite to the bridge member 56, as illustrated in chain lines in FIG. 10. As a result, the free end 53 of the movable member 52 is displaceable relative to the bottom wall 43. In the vicinity of the free end 53, a plurality of projections 54 are formed as a striking head on at least a surface of the movable member 52 confronting the bottom wall 43.

In use, the free end 53 of the movable member 52 is lifted up by the fingers and quickly released. The projections 54 then strike the bottom wall 43 as stated before.

Figure 11:
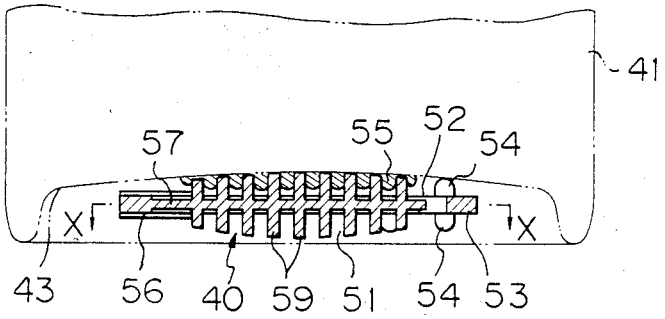
FIG. 11 is a side sectional view of the lower part of the can shown in FIG. 8, illustrating a cross section of the vibrating means taken along the line Y—Y in FIG. 9.

The curvature of the surface of the mounting member 51 to be fixed on the bottom wall 43 of the can 41 is matched with that of the bottom wall 43 so that the mating surfaces are in tight contact, as shown in FIG. 11. Moreover, the shape of the vibrating means 40 is symmetrical relative to a center plane x—x of FIG. 11. This facilitates the ease of positioning of the vibrating means 40 in place on the bottom wall 43 when the former is randomly fed onto the latter in the automated assembly line of the can, i.e., it can naturally occupy a central position of the bottom wall 43 and causes no problem even if it is upside down.

Figure 12:
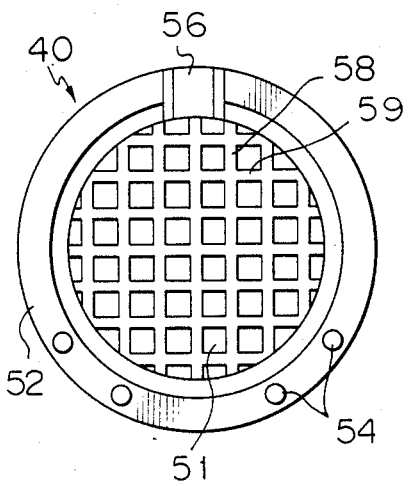
FIGS. 12 through 14 illustrate further embodiments of the vibrating means shown in FIGS. 8 through 11.
Figure 13:
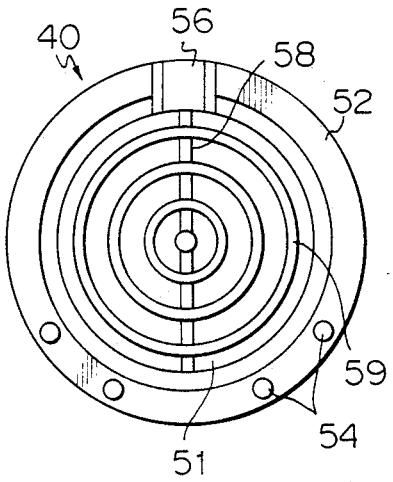
Figure 14:
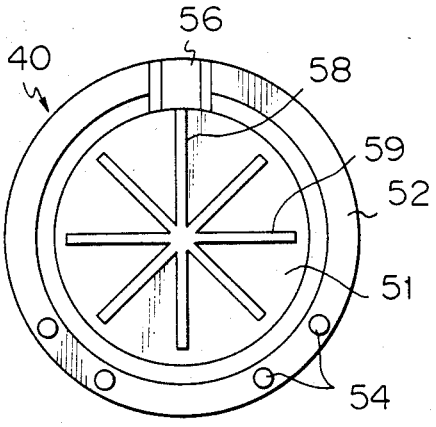

The mounting member 51 comprises a base 57 having a disc shape, both sides of which have a center rib 58 and a plurality of parallel lateral ribs 59 orthogonal to the center rib 58, as illustrated in FIGS. 9 and 11. The outer edges of the ribs 58, 59 are tapered to form a substantially convex contacting surface complementary to the bottom wall 43, as stated before. According to this structure, an adhesive 55 such as a hot melt resin deposited on the bottom wall 43 can widely invade a cavity between the ribs and, therefore, produce a desirable fixation of the vibrating means. The ribs 58, 59 may be arranged in a different manner, such as lattice form, concentric form, or radial form as illustrated in FIGS. 12 through 14. Of course, the contacting surface need not be constructed with the ribs, provided a roughened surface suitable for fixation to the can's wall is obtainable, such as by notches or the like.

Figure 15:
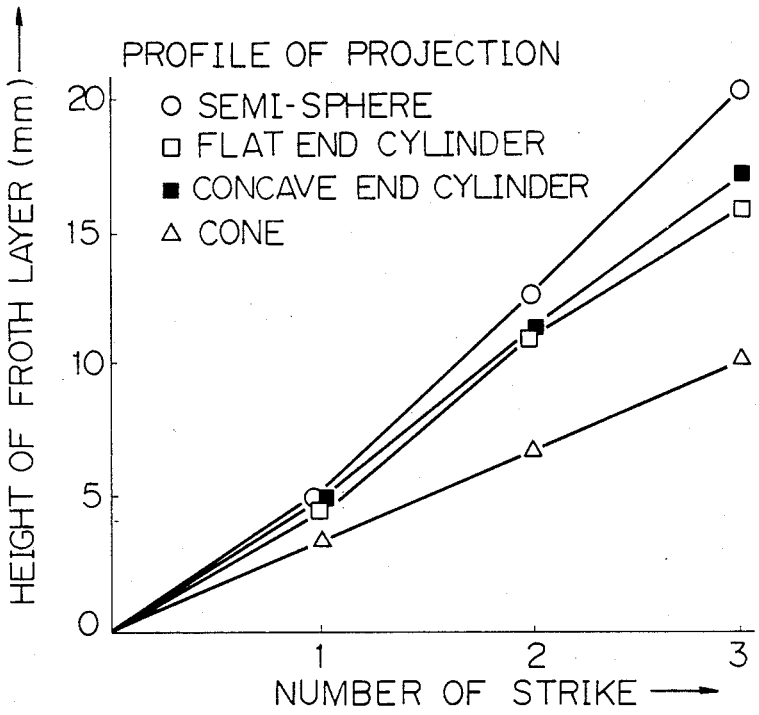
FIG. 15 is a graph illustrating the effect of cross sections of a projection having different shapes on frothing.
Figure 16A:
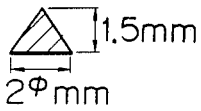
FIG. 16 (*a–d*) illustrates various cross sectional profiles of the projections in FIG. 15.
Figure 16B:
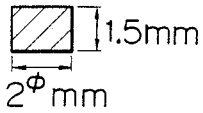
Figure 16C:
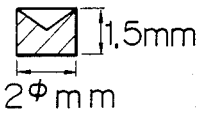
Figure 16D:
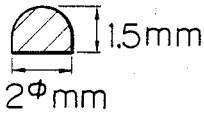

According to the present inventors, it has been found that the arrangement and profile of the projection 54 are very important for frothing the beer. FIG. 15 is a graph illustrating the degree of the generation of the microfroth in relation to a cross sectional profile of the projection 54. The experiment was carried out under conditions wherein the temperature of the beer was 8° C. and the temperature of the air was 21° C. and four vibrating means were utilized, each of which was substantially identical to that described above but having a different projection profile, as shown in FIG. 16(*a*) through (*d*), and was secured on the bottom wall 43 of the respective can 41. The ordinate of the graph represents a height of a microfroth layer on the beer surface generated by the strike and the abscissa thereof shows the number of strikes. As is apparent from the graph, the projection having a semispherical profile (d) was the most effective and that having a conical profile the most inferior. These results were analyzed as follows:

In the case of the conical profile, a pressure imparted to a unit area of the bottom wall is so large that the striking force is mainly consumed in deforming the bottom wall, and the vibration is not transmitted to the beer accommodated therein. Contrary to this, in the case of the semi-spherical profile, the pressure at the bottom wall becomes adequate to froth the beer.

Comparison between a flat end cylinder (b) and a concaved end cylinder (c) shows that the latter is somewhat superior to the former. It is surmised that this is because the latter touches the bottom wall only with a periphery portion, allowing a non-contacting space inside, whereby the vibrations of the bottom wall imparted by the periphery portion of the projection can continue without interfering with each other.

Figure 17:
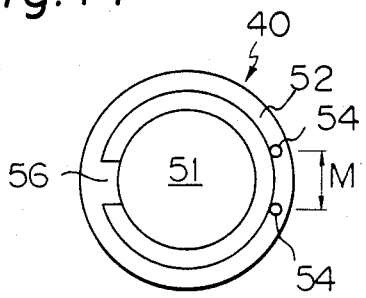
FIG. 17 is a plan view of a vibrating means utilized in the frothing experiment.
Figure 18:
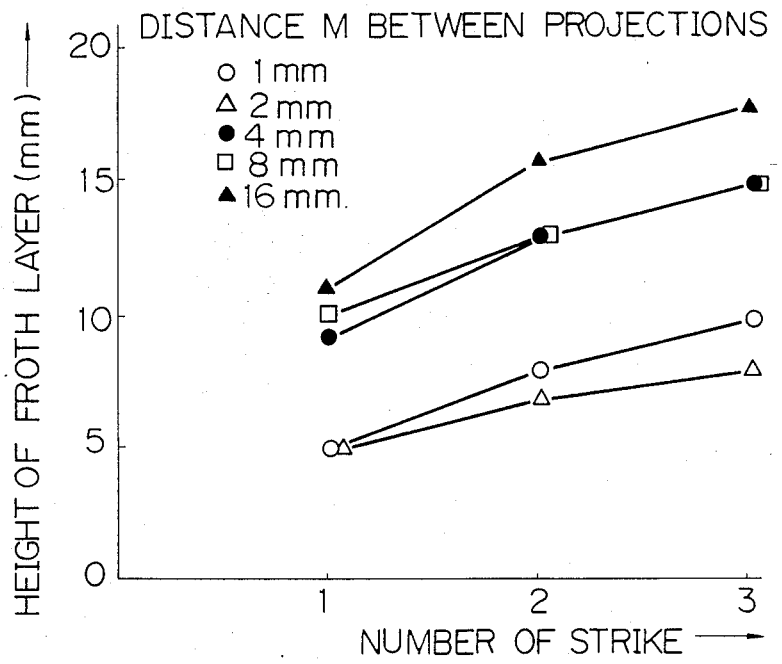
FIG. 18 is a graph illustrating the effect of a distance between the projections on frothing.

In order to study the relationship between a distance between two striking points on the bottom wall in more detail, another experiment was carried out by utilizing five vibrating means having a basic shape as shown in FIG. 17. Each vibrating means has two projections 54, a distance M therebetween being different from each other. The test results are illustrated by the graph shown in FIG. 18. As is apparent from the graph, the height of the froth layer increases as according to an increase in the distance M, except where the distance is less than 2 mm. However, when the distance M exceeds 3 mm, the height of froth layer tends to saturate even if the distance M increases. This suggests there may be a preferable range of the distance M for generation of the froth. By taking into account such a preferable distance between the projections and the area of the bottom wall of the can, the number of projections is preferably in the range of 1 to 20.

Figure 19:
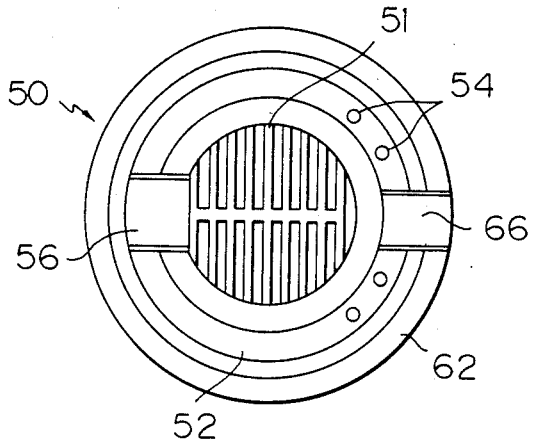
FIGS. 19 through 24 illustrate various modifications of the vibrating means according to the present invention.
Figure 20:
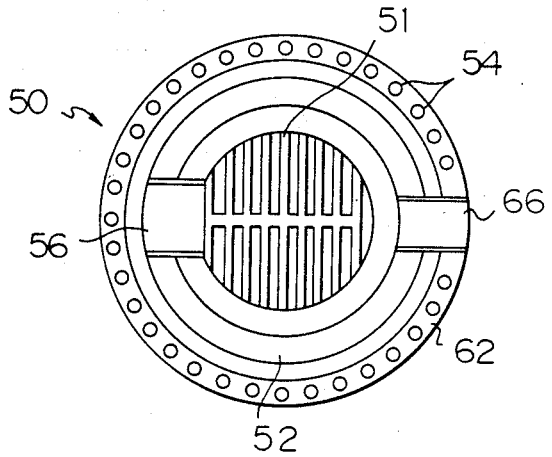
Figure 21:
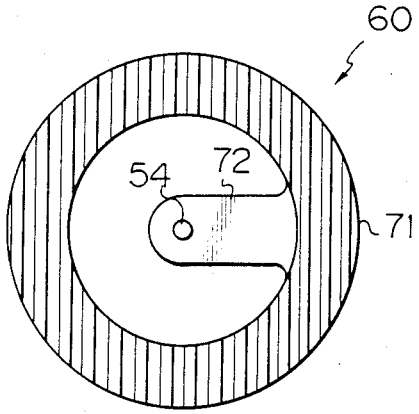
Figure 22:
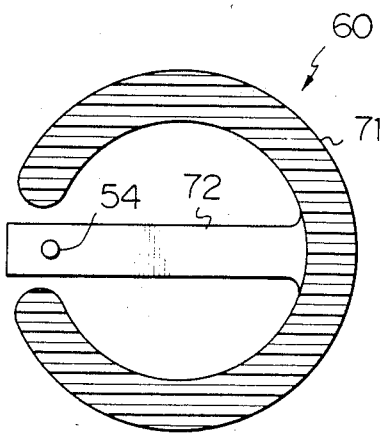
Figure 23:
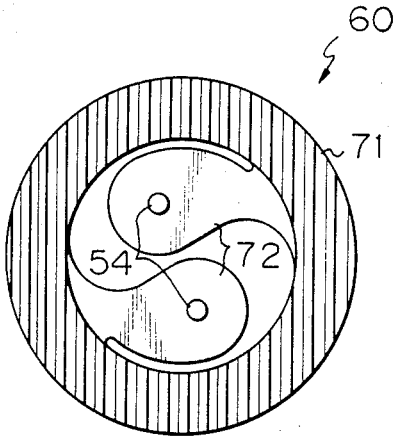
Figure 24:
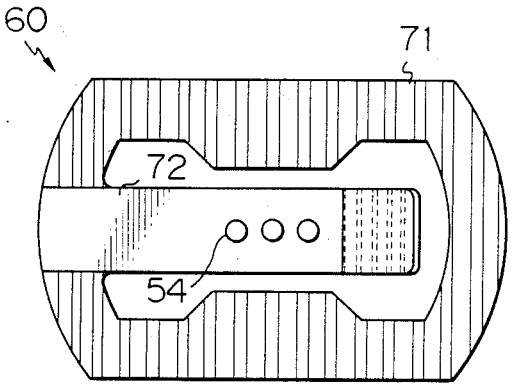

Another aspect of the preferable vibrating means 50 is shown in FIG. 19. In this embodiment, a second annular movable member 62 is added to the vibrating means 40 shown in FIGS. 8 through 11. The second movable member 62 encircles the first movable member 52 and is resiliently connected thereto by a second bridge member 66 at a part of its periphery diametrically opposite to the first bridge member 46. The remaining structure thereof is identical to that of the vibrating mean 40. According to this aspect, the striking action can be performed even without looking only by picking up any part of the second movable member 62. This aspect may be modified as shown in FIG. 20, which has a plurality of projections 54 throughout the periphery of the second movable member 62 instead of on the specified area of the first movable member 52.

In FIGS. 21 through 24, other alternatives of the vibrating means 60 according to the present invention are illustrated, in which a movable member 72 is disposed inside of the vibrating means and, in turn, a mounting member 71 encircles the movable member 72.

As stated above, according to the present invention, a can of beer or a vibrating means thereof is provided, which enables the user to form a layer of microfroth on a surface of the beer contained therein whenever the user wants to drink the beer. Moreover, the specific figure of the vibrating means enables automation of the assembly system of the can. The vibrating means according to the present invention can be made in one piece from a hard plastic such as polyethylene or ABS resin through a conventional molding method at an inexpensive cost.

We claim:

1. A beer container comprising a sealed container body and means for vibrating at least part of a wall of said container body, said vibrating means comprising a mounting member attached to the wall of said container body and a movable member, one part of which constituting a free end and the other part being resiliently connected to said mounting member so that a vibration is imparted to the wall by striking it with the free end of said movable member which has preliminarily been resiliently displaced against the wall, whereby a micro-froth layer may be produced on a surface of beer contained in said container body after opening of said container body.

2. A container defined by claim 1 wherein said vibrating means is attached to a side wall of said container body.

3. A container defined by claim 1 wherein said vibrating means is attached to a bottom wall of said container body.

4. A container defined by claim 1, wherein said sealed container body is openable.

5. A beer container comprising a sealed container body and means for vibrating at least part of a wall of said container body, said vibrating means comprising a mounting member attached to the wall of said container body and a movable member, one part of which constitutes a free end and the other part being resiliently connected to said mounting member so that a vibration is imparted to the wall by striking it with the free end of said movable member which has preliminarily been resiliently displaced against the wall, said vibrating means attached to a side wall of said container, said movable member of said vibrating means constituted in a form of an ear utilized as a handle of said container.

6. A vibrating means for forming a microfroth layer on a surface of beer to be used while attached to a bottom wall of a beer container, comprising a mounting member to be fixed to the bottom wall of said container and a movable member provide with a free end portion at one part thereof and resiliently connected to said mounting member at the other part thereof, the free end portion having at least one projection at a position thereof opposite to the bottom wall of said container when said vibrating means is positioned in place, so that said projection can strike the bottom wall of said container when said movable member is released from a resiliently displace condition to a free condition, a profile of said projection to be in contact with said bottom wall of said container being so designed that the strike thereby imparts no deformation to the bottom wall of said container and the maximum width of the contacting area is sufficiently smaller relative to a wavelength of the vibration propagated in the wall of said container by the strike.

7. A vibrating means defined by claim 6, wherein said projections are arranged at a distance of more than 3 mm from each other.

8. A vibrating means defined by claim 7, wherein said mounting member is constituted by a disc having a convex upper and/or lower surface complementary to that of the bottom wall of said container and said movable member comprises an annular ring encircling said mounting member, said both members being connected to each other by a bridge member provided between confronting parts of peripheries of said both members, said projections being arranged in the upper and/or lower surfaces of the free end portion of said movable member which portions corresponds to a part of said movable member arranged diametrically opposite to said bridge member.

9. A vibrating means defined by claim 6, wherein said mounting member is constituted by a disc having a convex upper and/or lower surface complementary to that of the bottom wall of said container and said movable member comprises an annular ring encircling said mounting member, said both members being connected to each other by a bridge member provided between confronting parts of peripheries of said both members, said projections being arranged in the upper and/or lower surfaces of the free end portion of said movable member which portion corresponds to a part of said movable member arranged diametrically opposite to said bridge member.

10. A vibrating means defined by claim 9, wherein said upper and/or lower surfaces of said mounting member is roughened to provide a desirable bonding effect when said mounting member is to be adhered to the bottom wall of said container.

11. A vibrating means defined by claim 10, wherein said roughened surface is formed of a plurality of ribs.

12. A vibrating means defined by claim 11, wherein said ribs are arranged in parallel to each other.

13. A vibrating means defined by claim 11, wherein said ribs are arranged in a lattice form.

14. A vibrating means defined by claim 11, wherein said ribs are arranged radially to each other.

15. A vibrating means defined by claim 11, wherein said ribs are arranged concentrically with each other.

16. A vibrating means defined by claim 9 wherein said vibrating means is of a symmetric form relative to an imaginary plane dividing the upper and lower parts of said vibrating means.

17. A vibrating means for forming a microfroth layer on a surface of beer to be used while attached to a container of beer, comprising a mounting member to be attached to the bottom wall of a container, a first movable member encircling said mounting member and a second movable member encircling said first movable member, said mounting member being resiliently connected to said first movable member at a part of a periphery thereof with a first bridge member and, in turn, said second movable member being resiliently connected to said first movable member at a part of a periphery thereof with a second bridge member which is disposed at a position diametrically opposite to said first bridge member, at least one projection being provided on either side of said first movable member in the vicinity of said second bridge member and/or on either side of said second bridge member along the entire periphery thereof.

18. A vibrating means for frothing beer to be used while attached to a bottom wall of a container of beer, comprising an annular shaped mounting member to be attached to wall of said container and a bar shaped movable member resiliently connected, at an end thereof, to said mounting member, diametrically extending inward therefrom so as to form a free end provided with at least one projection on said free end.

19. A method for forming a micro-froth layer on a surface of beer in an openable container containing said beer comprising the steps of: opening said container and vibrating at least a part of wall of said container by striking said part of the wall with a movable member resiliently mounted to said container.

20. A beer container comprising a sealed container body and means for vibrating at least part of a wall of said container body, said vibrating means comprising a mounting member attached to the wall of said container and a movable member, one part of which constituting a free end and the other part being resiliently connected to said mounting member so that a vibration is imparted to the wall by freely vibrating the free end of said movable member, said vibrating means attached to a side wall of said container, said movable member of said vibrating means constituted in a form of an ear utilized as a handle of said container.

* * * * *